United States Patent [19]

Lee et al.

[11] Patent Number: 4,606,934

[45] Date of Patent: Aug. 19, 1986

[54] PROCESS FOR PREPARING OVERCOATED ELECTROPHOTOGRAPHIC IMAGING MEMBERS

[75] Inventors: Lieng-Huang Lee, Webster; Deborah J. Nichol-Landry; Christine J. Tarnawskyj, both of Rochester, all of N.Y.

[73] Assignee: Xerox Corporation, Stamford, Conn.

[21] Appl. No.: 647,087

[22] Filed: Sep. 4, 1984

[51] Int. Cl.[4] ..... B05D 5/12

[52] U.S. Cl. ..... 427/76; 430/67; 430/132

[58] Field of Search ..... 430/67, 132; 427/76

[56] References Cited

U.S. PATENT DOCUMENTS

| | | | |
|---|---|---|---|
| 3,909,424 | 9/1975 | Clark | 252/12 |
| 3,953,206 | 4/1976 | Weigl | 96/1 LY |
| 3,957,725 | 5/1976 | Limburg | 260/46.5 R |
| 3,986,997 | 10/1976 | Clark | 260/29.2 M |
| 4,027,073 | 5/1977 | Clark | 428/412 |
| 4,250,240 | 2/1981 | Shimada et al. | 430/66 |
| 4,263,388 | 4/1981 | Schank et al. | 430/59 |
| 4,298,655 | 11/1981 | Kray | 428/412 |
| 4,330,583 | 5/1982 | Datta et al. | 428/65 |
| 4,340,629 | 7/1982 | Hillenbrand et al. | 428/64 |
| 4,371,600 | 2/1983 | Schank et al. | 430/56 |
| 4,407,920 | 10/1983 | Lee et al. | 430/59 |
| 4,423,131 | 12/1983 | Limburg et al. | 430/59 |
| 4,439,509 | 3/1984 | Schank | 430/132 |

FOREIGN PATENT DOCUMENTS

| | | |
|---|---|---|
| 0095910 | 7/1983 | European Pat. Off. . |
| 2115944 | 9/1983 | United Kingdom . |

*Primary Examiner*—Norman Morgenstern
*Assistant Examiner*—Kenneth Jaconetty
*Attorney, Agent, or Firm*—Peter H. Kondo

[57] ABSTRACT

A process for forming an overcoated electrophotographic imaging member comprising applying on an electrophotographic imaging member a coating in liquid form comprising a cross-linkable siloxanol-colloidal silica hybrid material having at least one silicon bonded hydroxyl group per every three —SiO— units and a catalyst for the cross-linkable siloxanol-colloidal silica hybrid material, the coating in liquid form having an acid number less than about 1 and curing the cross-linkable siloxanol-colloidal silica hybrid material until the siloxanol-colloidal silica hybrid material forms a hard cross-linked solid organosiloxane-silica hybrid polymer layer.

12 Claims, No Drawings

PROCESS FOR PREPARING OVERCOATED ELECTROPHOTOGRAPHIC IMAGING MEMBERS

BACKGROUND OF THE INVENTION

This invention relates to a process for preparing overcoated electrophotographic imaging members and more particularly, to a process of preparing electrophotographic imaging members overcoated with a solid cross-linked organosiloxane colloidal silica hybrid polymer substantially free of ionic components.

The formation and development of electrostatic latent images utilizing electrophotographic imaging members is well known. One of the most widely used processes being xerography as described by Carlson in U.S. Pat. No. 2,297,691. In this process, an electrostatic latent image formed on an electrophotographic imaging member is developed by applying electroscopic toner particles thereto to form a visible toner image corresponding to the electrostatic latent image. Development may be effected by numerous known techniques including cascade development, powder cloud development, magnetic brush development, liquid development and the like. The deposited toner image is normally transferred to a receiving member such as paper.

Electrophotographic imaging systems may utilize single multilayered organic or inorganic photoresponsive devices. In one photoresponsive device, a substrate is overcoated with a hole injecting layer and a hole transport layer. These devices have been found to be very useful in imaging systems. The details of this type of overcoated photoreceptor are fully disclosed, for example, in U.S. Pat. No. 4,265,990. The entire disclosure of this patent is incorporated herein by reference. If desired, multilayered photoresponsive devices may be overcoated with a protective layer. Other photoreceptors that may utilize protective overcoatings include inorganic photoreceptors such as the selenium alloy photoreceptors, disclosed in U.S. Pat. No. 3,312,548, the entire disclosure of which is incorporated herein by reference.

When utilizing such an organic or inorganic photoresponsive device in different imaging systems, various environmental conditions detrimental to the performance and life of the photoreceptor from both a physical and chemical contamination viewpoint can be encountered. For example, organic amines, mercury vapor, human fingerprints, high temperatures and the like can cause crystallization of amorphous selenium photoreceptors thereby resulting in undesirable copy quality and image deletion. Further, physical damage such as scratches on both organic and inorganic photoresponsive devices can result in unwanted printout on the final copy. In addition, organic photoresponsive devices sensitive to oxidation amplified by electric charging devices can experience reduced useful life in a machine environment. Also, with certain overcoated organic photoreceptors, difficulties have been encountered with regard to the formation and transfer of developed toner images. For example, toner materials often do not release sufficiently from a photoresponsive surface during transfer or cleaning thereby forming unwanted residual toner particles thereon. These unwanted toner particles are subsequently embedded into or transferred from the imaging surface in subsequent imaging steps, thereby resulting in undesirable images of low quality and/or high background. In some instances, the dry toner particles also adhere to the imaging member and cause printout of background areas due to the adhesive attraction of the toner particles to the photoreceptor surface. This can be particularly troublesome when elastomeric polymers or resins are employed as photoreceptor overcoatings. For example, low molecular weight silicone components in protective overcoatings can migrate to the outer surface of the overcoating and act as an adhesive for dry toner particles brought into contact therewith in the background areas of the photoreceptor during xerographic development. These toner deposits result in high background prints.

When silicone protective overcoatings such as polysiloxane resins containing an ionic component are used on photoreceptors, good copies may be obtained at normal ambient conditions such as at about 20° C. and 50 percent relative humidity. Examples of such silicone protective overcoatings photoreceptors, good copies may be obtained at normal ambient can be found for example in U.S. Pat. No. 4,439,509 and U.S. Pat. No. 4,407,920. However, under cycling conditions over an extended period of time at elevated temperatures and high relative humidity, such silicone overcoated photoreceptors containing an ionic component begin to produce copies that are characterized by deletions in the images.

SUMMARY OF THE INVENTION

It is a feature of the present invention to provide improved overcoated electrophotographic imaging members which overcome many of the abovenoted disadvantages.

A further feature of the present invention is to provide a cured silicone overcoating for electrophotographic imaging members which does not degrade images under cycling conditions over an extended period of time at elevated temperatures and high relative humidity.

It is another feature of the present invention to provide an overcoating which achieves excellent release and transfer of toner particles from an electrophotographic imaging member.

It is still another feature of the present invention to provide an overcoating which extends the useful life of electrophotographic imaging members.

These and other features of the present invention are accomplished by coating an electrophotographic imaging member with a coating in liquid form comprising a cross-linkable siloxanol-colloidal silica hybrid material having at least one silicon bonded hydroxyl group per every three —SiO— units on the electrophotographic imaging member and a catalyst for the cross-linkable siloxanol-colloidal silica hybrid material, the coating in liquid form having an acid number less than about 1, and curing the cross-linkable siloxanol-colloidal silica hybrid material until the siloxanol-colloidal silica hybrid material forms a hard cross-linked solid organosiloxane-silica hybrid polymer layer.

Examples of cross-linkable siloxanol-colloidal silica hybrid materials that are useful in the present invention are esentially the same as those materials commercially available from Dow Corning, such as Vestar Q9-6503 and from General Electric such as SHC-1000, and SHC-1010 except that the cross-linkable siloxanol-colloidal silica hybrid material compositions are substantially free of ionic components such as acids, metal salts of organic and inorganic acids and the like. Cross-linkable siloxanol-colloidal hybrid material having an acid number less than about 1 is available from Dow Corning Co. The expression "substantially free of ionic components" is defined as having an acid number of less than about 1. Determination of acid number may be accomplished by any suitable conventional technique such as by titrating the cross-linkable siloxanol-colloidal silica hybrid solution with an alcoholic KOH solution at 0.1N. When Bromocresole Purple is used as an indicator, the color is yellow at a pH of 5.2. The endpoint of the titration is pH 6.4 at which point the color of the solution changes to purple. The acid number is calculated as:

$$\frac{\text{Volume}_{(KOH)}^{(ml)} \times \text{Concentration}_{(KOH)}}{\text{sample weight in grams}}.$$

These cross-linkable siloxanol-colloidal silica hybrid materials have been characterized as a dispersion of colloidal silica and a partial condensate of a silanol in an alcohol-water medium.

These cross-linkable siloxanol-colloidal silica hybrid materials are believed to be prepared from trifunctional polymerizable silanes preferably having the structural formula:

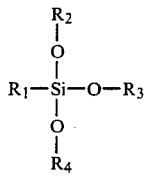

wherein $R_1$ is an alkyl or alkylene group having 1 to 8 carbon atoms or a phenyl group, and $R_2$, $R_3$ and $R_4$ are independently selected from the group consisting of methyl and ethyl.

The OR groups of the trifunctional polymerizable silane are hydrolyzed with water and the hydrolyzed material is stabilized with colloidal silica, alcohol, and a minimal amount of acid wheby the acid number of the resulting mixture is less than about 1. At least some of the alcohol may be provided from the hydrolysis of the alkoxy groups of the silane. The stabilized material is partially polymerized as a prepolymer prior to application as a coating on an electrophotographic imaging member. The degree of polymerization should be sufficiently low with sufficient silicon bonded hydroxyl groups so that the organosiloxane prepolymer may be applied in liquid form with or without a solvent to the electrophotographic imaging member. Generally, this prepolymer can be characterized as a siloxanol polymer having at least one silicon-bonded hydroxyl group per every three —SiO— units. Typical trifunctional polymerizable silanes include methyl triethoxysilane, methyl trimethoxysilane, vinyl triethoxysilane, vinyl trimethoxysilane, vinyl triethoxysilane, butyl triethoxysilane, propyl trimethoxysilane, phenyl triethoxysilane and the like. If desired, mixtures of trifunctional silanes may be employed to form the cross-linkable siloxanol-colloidal silica hybrid. Methyl trialkoxy silanes are preferred because polymerized coatings formed therefrom are more durable and are more abhesive to toner particles.

The silica component of the coating mixture is present as colloidal silica. The colloidal silica is available in aqueous dispersions in which the particle size is between about 5 and about 150 millimicrons in diameter. Colloidal silica particles having an average particle size between about 10 and about 30 millimicrons provide coatings with the greatest stability. An example of a method of preparing the cross-linkable siloxanol-colloidal silica hybrid material is described in U.S. Pat. Nos. 3,986,997, 4,027,073, and 4,439,509, the entire disclosure of each patent being incorporated by reference herein. However, unlike the method described in U.S. Pat. Nos. 3,986,997, 4,027,073, and 4,439,509, no acid is utilized during preparation of the cross-linkable siloxanol-colloidal silica hybrid material to achieve an acid number of less than about 0.5 which is mainly due to the silanol groups. The use of no acid increases the preparation time but reduces the amount of ionic contaminants in the final cured coating. The dispersion was filtered through a 1-micron filter to remove large silica particles. No stabilizer is added to prevent any gellation or settling at room temperature.

Since a cross-linkable siloxanol-colloidal silica hybrid material having a low acid number tends to form microgels and come out of disperion at room temperature, it must be refrigerated during storage. For example, a dispersion of a cross-linkable siloxanol-colloidal silica hybrid material having a low acid number will normally be lost due to the formation of microgels after several months at a storage temperature of −9° C. Generally, storage at a freezer temperature of at less than about −20° C. is preferred to ensure avoidance of premature loss of the cross-linkable siloxanol-colloidal silica hybrid material dispersion prior to coating.

Since low molecular weight non-reactive oils are generally undesirable in the final overcoating, any such non-reactive oils should be removed prior to application to the electrophotographic imaging member. For example, linear polysiloxane oils tend to leach to the surface of solidified overcoatings and cause undesirable toner adhesion. Any suitable technique such as distillation may be employed to remove the undesirable impurities. However, if the stating monomers are pure, non-reactive oils are not present in the coating.

Minor amounts of resins may be added to the coating mixture to enhance the electrical or physical properties of the overcoating. Examples of typical resins include polyurethanes, nylons, polyesters, and the like. Satisfactory results may be achieved when up to about 5 to 30 parts by weight of resin based on the total weight of the total coating mixture is added to the coating mixture prior to application to the electrophotographic imaging member.

Minor amounts of plasticizers may also be added to the coating mixture to enhance the physical properties of the overcoating, particularly when thick coatings are formed. Examples of typical plasticizers include hydroxy-terminated polydimethylsiloxane, octyl triethoxysilane, hydroxy-terminated polyester, hydroxy-terminated epoxy resin, lower molecular weight polyamide, and the like. Satisfactory results may be achieved when up to about 1 to 10 parts by weight of plasticizer based on the total weight of the cross-linkable siloxanol-colloidal silica hybrid material is added to the coating mixture prior to application to the electrophotographic imaging member. A hydroxy terminated polydimethylsiloxane plasticizer is preferred because it chemically reacts with the cross-linkable siloxanol-colloidal silica hybrid material and cannot leach to the surface of solidified overcoatings and cause undesirable toner adhesion.

The cross-linkable siloxanol-colloidal silica hybrid material of the present invention is applied to electrophotographic members as a thin coating having a thickness after cross-linking of from about 0.3 micrometer to about 3 micrometers. If coating thickness is increased above about 3 micrometers, high residual potential is likely to be encountered. Thicknesses less than about 0.3 micrometer are difficult to apply but may probably be applied with spraying techniques. Generally speaking, a thicker coating tends to wear better. Moreover, deeper scratches are tolerated with thicker coatings because the scratches do not print out as long as the surface of the electrophotographic imaging member itself is not contacted by the means causing the scratch. A cross-linked coating having a thickness from about 0.5 micron to about 2 microns is preferred from the viewpoint of optimizing electrical, transfer, cleaning and scratch resistance properties. These coatings also protect the photoreceptor from varying atmospheric conditions and can even tolerate contact with human hands.

Although minute amounts of ionic condensation catalysts may be tolerated to cure or assist in curing the cross-linkable siloxanol-colloidal silica hybrid material so long as the acid number of the coating mixture is maintained below about 1, catalysts free of ionic components are preferred for curing the cross-linkable siloxanol-colloidal silica hybrid material because print deletion at high temperatures and high relative humidity is minimized or totally obviated. Typical condensation catalysts include aminosilanes such as gamma-aminopropyltriethoxysilane, trialkoxylsilanes such as methyl trimethoxysilane, gamma-methacryloxyl triethoxysilane, epoxy propyltrimethoxylsilane, chloropropyl trimethoxysilane, and the like.

The condensation catalyst is normally incorporated into the coating mixture containing the cross-linkable siloxanol-colloidal silica hybrid material prior to applying the coating mixture to the electrophotographic imaging member. If desired, the condensation catalyst may be ommited from the coating mixture. If a condensation catalyst is employed, the amount added to the coating mixture is normally less than about 10 percent by weight based on the weight of the cross-linkable siloxanol-colloidal silica hybrid material.

Selection of curing temperatures to cross-link the siloxanol-colloidal silica hybrid material depends upon the amount and type of catalyst employed. Generally, satisfactory curing may be achieved at curing temperatures between about 40° C. and about 100° C. when using a catalyst and temperatures between about 100° C. and about 140° C. when a catalyst is not employed. Curing time varies with the amount and type of catalyst employed as well as the temperature used. During curing of the cross-linkable siloxanol, i.e. partial condensate of a silanol, the residual hydroxyl groups condense to form a silsesquioxane, $RSiO_{3/2}$. When the overcoating is adequately cross-linked, it forms a hard, solid coating which is not dissolved by isopropyl alcohol. The cross-linked coating is exceptionally hard and resists scratching by a sharpened 5H or 6H pencil.

The cross-linkable siloxanol-colloidal silica hybrid material may be applied to the electrophotographic imaging member by any suitable technique. Typical coating techniques include blade coating, dip coating, roll coating, flow coating, spraying and draw bar application processes. Any suitable solvent or solvent mixture may be utilized to facilitate forming the desired coating film thickness. Alcohols such as methanol, ethanol, propanol, isopropanol, butanol, isobutanol and the like can be employed with excellent results for both organic and inorganic electrophotographic imaging members. The addition of solvents or diluents also seems to minimize microgel formation. If desired, solvents such as 2-methoxyethanol may be added to the coating mixture to control the evaporation rate during the coating operation.

If desired, a primer coating may be applied to the electrophotographic imaging member to improve adhesion of the cross-linked siloxanol-colloidal silica hybrid material to the electrophotographic imaging member. Typical primer coating materials include, for example, polyesters (e.g. Vitel PE-100, PE-200), polymethyl methacrylate, poly(carbonate-co-ester) (e.g. GE Lexan 3250), polyalkyl methacrylates, and the like and mixtures thereof. A primer coating of poly(carbonate-co-ester) and polymethyl methactylate having a weight ratio of about 80:20 is preferred for selenium and selenium alloy electrophotographic imaging members because of the maximum adhesion obtained.

Any suitable electrophotographic imaging member may be coated with the process of this invention. The electrophotographic imaging members may contain inorganic or organic photoresponsive materials in one or more layers. Typical photoresponsive materials include selenium, selenium alloys, such as arsenic selenium and tellurium selenium alloys, halogen doped selenium, and halogen doped selenium alloys. Typical multi-layered electrophotographic imaging members include those described in U.S. Pat. No. 4,265,990, which comprises a substrate, a generating layer such as trigonal selenium or vanadyl phthalocyanine in a binder and a transport layer. Another example of a multi-layered photoresponsive device is one which has a thin generator selenium alloy layer having a thickness of about 0.5 micrometer and a transport layer comprising a diamine in a polycarbonate binder having a thickness of about 15–40 micrometers. Still another example of a multi-layered electrophotographic imaging member is one which comprises a hole transport layer, a photogenerating layer, and a photoconductive layer such as described in U.S. application Ser. No. 488,250, filed Apr. 25, 1983 in the name of A. M. Horgan, the entire disclosure being incorporated herein by reference.

The electrophotographic imaging member may be of any suitable configuration. Typical configurations include sheets, webs, flexible or rigid cylinders, and the like. Generally, the electrophotographic imaging members comprise a supporting substrate which may be electrically insulating, electrically conductive, opaque or substantially transparent. If the substrate is electrically insulating, an electrically conductive layer is usually applied to the substrate. The conductive substrate or conductive layer may comprise any suitable material such as aluminum, nickel, brass, conductive particles in a binder, and the like. For flexible substrates, one may utilize any suitable conventional substrate such as aluminized Mylar. Depending upon the degree of flexibility desired, the substrate layer may be of any desired thickness. A typical thickness for a flexible substrate is from about 3 mils to about 10 mils.

Generally, electrophotographic imaging members comprise one or more additional layers on the conductive substrate or conductive layer. For example, depending upon flexibility requirements and adhesive properties of subsequent layers, one may utilize an adhesive layer. Adhesive layers are well known and examples of typical adhesive layers are described in U.S. Pat. No. 4,265,990.

One or more additional layers may be applied to the conductive or adhesive layer. When one desires a hole injecting conductive layer coated on a substrate, any suitable material capable of injecting charge carriers under the influence of an electric field may be utilized. Typical of such materials include gold, graphite or carbon black. Generally, the carbon black or graphite dispersed in the resin are employed. This conductive layer may be prepared, for example, by solution casting of a mixture of carbon black or graphite dispersed in an adhesive polymer solution onto a support substrate such as Mylar or aluminized Mylar. Typical examples of resins for dipsersing carbon black or graphite include polyesters such as Vitel PE 100 commercially available from Goodyear Tire & Rubber Company, polymeric esterification products of a dicarboxylic acid and a diol comprising a diphenol, such as 2,2-bis(3-beta-hydroxyethoxyphenyl)propane, 2,2-bis(4-hydroxyisopropoxyphenyl)propane, 2,2-bis(4-beta-hydroxyethoxyphenyl)-pentane and the like and a dicarboxylic acid such as oxalic acid, malonic acid, succinic acid, phthalic acid, terephthalic acid, and the like. The weight ratio of polymer to carbon black or graphite may range from about 0.5:1 to 2:1 with the preferred range being about 6:5. The hole injecting layer may have a thickness in the range of from about 1 micron to about 20 microns, and preferably from about 4 microns to about 10 microns.

A charge carrier transport layer may be overcoated on the hole injecting layer and may be selected from numerous suitable materials capable of transporting holes. The charge transport layer generally has a thickness in the range of from about 5 to about 50 microns and preferably from about 20 to about 40 microns. A charge carrier transport layer preferably comprises molecules of the formula:

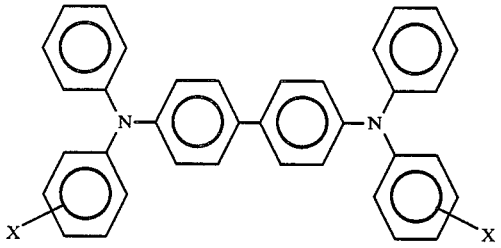

dispersed in a highly insulating and transparent organic resinous material wherein X is selected from the group consisting of (ortho) $CH_3$, (meta) $CH_3$, (para) $CH_3$, (ortho) Cl, (meta) Cl, and (para) Cl. The charge transport layer is substantially non-absorbing in the spectral region of intended use, e.g., visible light, but is "active" in that it allows injection of photogenerated holes from the charge generator layer and electrically induced holes from the injecting surface. A highly insulating resin, having a resistivity of at least about $10^{12}$ ohm-cm to prevent undue dark decay will not necessarily be capable of supporting the injection of holes from the injecting generating layer and is not normally capable of allowing the transport of these holes through the resin. However, the resin becomes electrically active when it contains from about 10 to about 75 weight percent of, for example, N,N,N',N'-tetraphenyl-[1,1'-biphenyl]-4,4'-diamine corresponding to the structural formula above. Other materials corresponding to this formula include, for examples, N,N'-diphenyl-N,N'-bis-(alkylphenyl)-[1,1'-biphenyl]-4,4'-diamine wherein the alkyl group is selected from the group consisting of methyl such as 2-methyl, 3-methyl and 4-methyl, ethyl, propyl, butyl, hexyl, and the like. In the case of chloro substitution, the compound may be N,N'-diphenyl-N,N'-bis(halophenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes includes triphenylmethane, bis(4-diethylamino-2-methylphenyl)-phenylmethane, 4',4''-bis(diethylamino)-2,'2''-dimethyltriphenylmethane, bis-4(diethylaminophenyl)-phenylmethane, and 4,4'-bis(diethylamino)-2',2''-dimethyltriphenylmethane.

The generating layer that may be utilized, in addition to those disclosed herein, can include, for example, pyrylium dyes, and numerous other photoconductive charge carrier generating materials provided that these materials are electrically compatible with the charge carrier transport layer, that is, they can inject photoexcited charge carriers into the transport layer and the charge carriers can travel in both directions across the interface between the two layers. Particularly useful inorganic photoconductive charge generating material include amorphous selenium, trigonal selenium, selenium-arsenic alloys and selenium-tellurium alloys and organic charge carrier generating materials including the X-form of phthalocyanine, metal phthalocyanines and vanadyl phthalocyanines. These materials can be used alone or as a dispersion in a polymeric binder. This layer is typically from about 0.5 to about 10 microns or more in thickness. Generally, the thickness of the layer should be sufficient to absorb at least about 90 percent or more of the incident radiation which is directed upon it in the imagewise exposure step. The maximum thickness is dependent primarily upon mechanical considerations such as whether a flexible photoreceptor is desired.

The electrophotographic imaging member can be imaged by the conventional steps of uniformly depositing an electrostatic charge and exposing to an imagewise pattern of electromagnetic radiation to which the charge carrier generating layer is responsive to form an electrostatic latent image on the electrophotographic imaging member. The electrostatic latent image formed may then be developed by conventional means resulting in a visible image. Conventional development techniques such as cascade development, magnetic brush development, liquid development, and the like may be utilized. The visible image is typically transferred to a receiving member by conventional transfer techniques and permanently affixed to the receiving member.

The cross-linkable siloxanol-colloidal silica hybrid materials of the present invention can also be used as overcoatings for three layered organic electrophotographic imaging members as indicated hereinabove and in the Examples below. For example, in U.S. Pat. No. 4,265,990, an electrophotographic imaging device is described which comprises a substrate, a generating layer, and a transport layer. Examples of generating layers include trigonal selenium and vanadyl phthalocyanine. Examples of transport layers include various diamines dispersed in a polymer as disclosed hereinabove and in the Examples below.

The cross-linkable siloxanol-colloidal silica hybrid materials of the instant invention are soluble in solvents such as alcohol and thus can be conveniently coated from alcoholic solutions. However, once the organosiloxane-silica hybrid material is cross-linked into its resinous state, it is no longer soluble and can withstand cleaning solutions such as ethanol and isopropanol. Additionally, because of their excellent transfer and cleaning characteristics, the overcoated electrophotographic imaging devices of the present invention may be utilized in liquid development systems. Moreover, inorganic or organic electrophotographic imaging devices coated with the cross-linked organosiloxane-silica hybrid polymers of the present invention are highly resistant to the effects of high humidity combined with high temperatures.

The invention will now be described in detail with respect to specific preferred embodiments thereof, it being understood that these embodiments are intended to be illustrative only and that the invention is not intended to be limited to the specific materials, conditions, process parameters and the like recited herein. Parts and percentages are by weight unless otherwise indicated.

EXAMPLE I

A control experiment was conducted with a photoreceptor comprising a cylindrical aluminum substrate having a diameter of about 8.3 centimeters and a length of about 33 centimeters coated with a vacuum-deposited first layer having a thickness of about 55 micrometers and containing about 99.5 percent by weight selenium, about 0.5 percent by weight arsenic and about 20 parts-per-million chlorine and a vacuum-deposited second outer layer having a thickness of about 5 micrometers and containing about 90 percent by weight selenium and about 10 percent by weight tellurium. A primer containing a 0.5 percent solution of an 80:20 weight ratio of polyester (Vitel PE-200 available from Goodyear Rubber & Tire Co.)/polymethyl methacrylate in a 1:1 volume ratio of $CH_2Cl_2/Cl_2CHCH_2Cl$ was applied by dip-coating in a cylindrical glass vessel. The flow time was about 5–6 seconds. The drum was air-dried and then dried at 45° C. for 30 minutes to form a coating having a thickness of less than about 0.04 micrometer. This primed drum was overcoated with a film of cross-linkable siloxanol-colloidal silica hybrid material commercially available from General Electric Company as SCH-1010 containing 25 percent solids in an isobutanol/isopropanol mixture. This cross-linkable organosiloxane-silica hybrid material solution contained 2 percent by weight of potassium acetate which functions as a high temperature cross-linking (curing) catalyst for the organosiloxane-silica hybrid material. The acid number of this cross-linkable organosiloxane-silica hybrid material solution containing potassium acetate, as determined by titration, was found to exceed 50. The titration procedure has already been described above. An additional amount of potassium acetate (3 percent) was added to accelerate curing and the solution was based on the silicone solids (10 percent) in isobutanol-/isopropanol mixture (55:45 by weight). The solution was applied by spraying. After air-drying at room temperature, the drum was thermally cured for one hour at about 45°–50° C. in an air oven. The cured cross-linked organosiloxane-silica solid polymer coating had a thickness of about 0.5 micrometer and could not be scratched with a sharpened 5H pencil. This overcoated photoreceptor was cycled through conventional xerographic imaging steps comprising uniform charging to 5.8 kV, exposure to a test pattern to form an electrostatic latent image corresponding to the test pattern, development with a magnetic brush developer applicator to form a toner image corresponding to the electrostatic latent image, electrostatically transfering the toner image to a sheet of paper and cleaning the overcoated photreceptor. The cycling was conducted in a controlled environment in which the temperature was maintained at 27° C. and the relative humidity maintained at 80 percent. Examination of the transferred toner images after 1,000 cycles revealed numerous print deletions. Print deletion can be the partial or total loss of image on the printed sheet of paper. This deletion is caused by lateral conductivity induced by the ionic contaminants.

EXAMPLE II

A photoreceptor comprising a cylindrical aluminum substrate having a diameter of about 8.3 centimeters and a length of about 33 centimeters coated with a vacuum deposited first layer having a thickness of about 55 micrometers and containing about 99.5 percent by weight selenium, about 0.5 percent by weight arsenic and about 20 parts per million chlorine and a vacuum-deposited second outer layer having a thickness of about 5 micrometers and containing about 90 percent by weight selenium and about 10 percent by weight tellurium. The drum was cleaned with isopropanol to remove any oxide or other contaminants. A primer containing a 0.5 percent solution of an 80:20 weight ratio of polyester (Vitel PE-200, available from Goodyear Rubber and Tire Co.)/polymethyl methacrylate in a 1:1 volume ratio of $CH_2Cl_2/Cl_2CHCH_2Cl$ was applied by dip-coating in a cylindrical glass vessel. The flow time was about 5–6 seconds. The drum was air-dried and then dried at 45° C. for 30 minutes to form a coating having a thickness of less than about 0.04 micrometer. This primed drum was overcoated with a film of cross-linkable siloxanol-colloidal silica hybrid material containing 5 percent solids in an isobutanol/isopropanol (55:45 by weight) mixture. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid material solution as determined by titration, was found to to be less than 1. This cross-linkable organosiloxane-silica hybrid material solution contained 58.6 grams of a 23.5 weight percent solution of the cross-linkable organosiloxane-silica hybrid material dissolved in isobutanol/isopropanol above, 116 grams of isopropanol, 224 grams of isobutanol, 1.4 grams of a low molecular weight hydroxy-terminated polydimethylsiloxane (Petrarch fluid available from Petrarch Chemical, Florida) and 0.5 gram of an aminosilane (gamma-aminopropyl triethoxysilane, A-1100 Silane, available from Union Carbide Co.). The solution was applied by spraying. After air-drying at room temperature, the drum was thermally cured for 3 hours at about 45°–50° C. in a forced-air oven. The cured cross-linked organosiloxane-silica solid polymer coating had a thickness of about 0.5 micrometer and could not be scratched with a sharpened 5H pencil. This overcoated photoreceptor was cycled through xerographic imaging steps comprising uniform charging to 5.8 kV, exposure to a test pattern to form an electrostatic latent image corresponding to the test pattern, development with a magnetic brush developer applicator to form a toner image corresponding to the electrostatic latent image, electrostatically transfering the toner image to a sheet of paper and cleaning the overcoated photoreceptor. The cycling was conducted in a controlled environment in which the temperature was maintained at 27° C. and the relative humidity maintained at 80 percent. Examination of the transferred toner images after 1,000 cycles revealed no print deletions. The print contained the entire image from the original, and exhibited excellent resolution. In comparing the print of this Example with that of Example I, it is apparent that the print deletion characteristics of a photoreceptor overcoated with a cured cross-linked organosiloxane-silica solid polymer are significantly affected by the presence or substantial absence of ionic components.

EXAMPLE III

A photoreceptor comprising a cylindrical aluminum substrate having a diameter of about 8.3 centimeters and a length of about 33 centimeters coated with a vacuum deposited layer having a thickness of about 55 micrometers and containing about 99.5 percent by weight selenium, about 0.5 percent by weight arsenic and about 20 parts-per-million chlorine and a vacuum-deposited second outer layer having a thickness of about 5 micrometers and containing about 90 percent by weight selenium and about 10 percent by weight tellurium. The drum was cleaned with isopropanol to remove any oxide or other contaminants. After drying, a Binks spray gun was employed to apply on the cylinder, at a relative humidity below 40 percent and at a room temperature of about 21° C., a 0.5 percent solution in methylene chloride/1,1,2 trichloroethane (6:4) mixture of a primer consisting of 0.4 gram poly(carbonate-co-ester) (Lexan 3250, available from General Electric Co.), 0.1 gram polymethyl methacrylate, 59.7 grams methylene chloride and 39.8 grams 1,1,2 trichloroethane. The drum was then dried at 45° C. for 30 minutes to yield a film thickness of approximately 0.04 micrometer. This primed drum was overcoated with a film of cross-linkable siloxanol-colloidal silica hybrid material containing 10 percent solids in a methanol/isopropanol mixture. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid material solution, as prepared and as determined by titration, was found to be below 1. This cross-linkable organosiloxane-silica hybrid material solution contained 58.6 grams of a 23.5 weight percent solution of the cross-linkable organosiloxane-silica hybrid material dissolved in a methanol/isopropanol mixture, 116 grams of isopropanol, 224 grams of isobutanol, 1.4 grams of a low molecular weight hydroxy-terminated polydimethylsiloxane (Petrarch fluid available from Petrarch Chemical, Florida), and 0.5 gram of of an aminosilane (A-1100 Silane, available from Union Carbide Co.). The solution was applied to the primed cylinder with a spray gun. After air-drying at room temperature, the drum was thermally cured at about 45°-50° C. in an air oven until the resulting hard cross-linked organosiloxane-silica hybrid polymer solid coating was completely resistant to rubbing by an isopropanol saturated Q-tip (curing time about 1-4 hours). The resulting hard cross-linked organosiloxane-silica hybrid polymer solid coating was completely resistant to rubbing by an isopropanol saturated Q-tip indicating that curing had taken place. The cured coating could not be removed from the cylinder by first applying to the overcoating and thereafter removing a strip of 3M 600 Scotch ® adhesive tape. The overcoating was also clear and free of cloudy areas.

EXAMPLE IV

A photoreceptor comprising a cylindrical aluminum substrate having a diameter of about 8.3 centimeters and a length of about 43 centimeters coated with a vacuum deposited layer having a thickness of about 55-60 micrometers and containing about 99.5 percent by weight selenium, about 0.5 percent by weight arsenic was cleaned with isopropanol to remove any oxide or other contaminants. After drying, a Binks spray gun was employed to apply on the cylinder, at a relative humidity below 40% and at a room temperature of about 21° C., a 0.5% solution in methylene chloride/1,1,2 trichloroethane (6:4) mixture of a primer consisting of 0.8 gram poly(carbonate-co-ester) (Lexan 3250, available from General Electric CO.), 0.2 gram polymethyl methacrylate, 59.7 grams methylene chloride, and 39.8 grams 1,1,2 trichloroethane. The drum was then dried at 45° C. for 30 minutes to yield a film thickness of approximately 0.04 micrometer. This primed drum was overcoated with a film of cross-linkable siloxanol-colloidal silica hybrid material containing 10 percent solids in an isobutanol/isopropanol (55:45) mixture. This cross-linkable organosiloxane-silica hybrid material solution was essentially the same as the cross-linkable organosiloxane-silica hybrid material solution of Example I except that less acid was used in the preparation of the cross-linkable organosiloxane-silica hybrid material. The acid number of this cross-linkable organosiloxane-silica hybrid material solution as determined by titration, was found to be below 1. This cross-linkable organosiloxane-silica hybrid material solution contained 58.6 grams of a 23.5 weight percent solution of the cross-linkable organosiloxane-silica hybrid material dissolved in isobutanol/isopropanol mixture, 116 grams of isopropanol, 224 grams of isobutanol, 1.4 grams of a low molecular weight hydroxy-terminated polydimethylsiloxane (Petrarch fluid available from Petrarch Chemical, Florida), 0.5 gram of an aminosilane (A-1100 Silane, available from Union Carbide Co.). The solution was applied to the primed cylinder with an automatic spray gun after air-drying at room temperature. After air drying, the drum was thermally cured at about 45°-50° C. in an air oven until the resulting hard cross-linked organosiloxane-silica hybrid polymer solid coating was completely resistant to rubbing by an isopropanol saturated Q-tip (curing time about 1-4 hours). The resulting hard cross-linked organosiloxane-silica hybrid polymer solid coating was completely resistant to rubbing by an isopropanol Q-tip indicating that curing had taken place. The cured coating could not be removed from the cylinder by first applying to the overcoating and thereafter removing a strip of 3M 600 Scotch ® adhesive tape. The overcoating was also clear and free of cloudy areas.

EXAMPLE V

The procedures of Example IV were repeated with the same conditions and materials except that the primer was replaced with a composition containing 0.8 gram polyester (Vitel PE-200, available from Goodyear Rubber and Tire Co.) and 0.2 gram polymethyl methacrylate.

Example VI

A photoreceptor comprising an electroformed nickel substrate having a thickness of 4.5–5.0 micrometers primed with a thin resin layer and coated with a vacuum deposited selenium alloy layer having a thickness of about 60 micrometers and containing about 99.67 percent by weight selenium and about 0.33 percent by weight arsenic was cleaned with isopropanol to remove any oxide or other contaminants. After drying, a Binks spray gun was employed to apply on the photoreceptor, at a relative humidity below 40% and at a room temperature of about 21° C., a 1% solution in methylene chloride/1,1,2 trichloroethane (6:4) mixture of a primer consisting of 0.8 gram poly(carbonate-co-ester) (Lexan 3250, available from General Electric Co.), 0.2 gram polymethyl methacrylate, 59.7 grams methylene chloride and 39.8 grams 1,1,2 trichloroethane. The photoreceptor was then dried at 45° C. for 30 minutes to yield a continuous film thickness of less than about 0.1 micrometer. This primed photoreceptor was overcoated with a film of cross-linkable siloxanolcolloidal silica hybrid material. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid materials solution, as determined by titration, was found to be below 1. This cross-linkable organosiloxane-silica hybrid material solution contained 58.6 grams of a 23.5 weight percent solution of the cross-linkable organosiloxane-silica hybrid material dissolved in isobutanol/isopropanol mixture, 116 grams of isopropanol, 224 grams of isobutanol, 1.4 grams of a low molecular weight hydroxy-terminated polydimethylsiloxane (Petrarch fluid available from Petrarch Chemical, Florida) and 0.5 gram of an amino silane (A-1100 Silane, available from Union Carbide Co.). The solution was applied to the primed photoreceptor with a spray gun. After air-drying at room temperature, the plate was thermally cured at about 45° C. in a air oven until the resulting hard cross-linked organosiloxane-silica hybrid polymer solid coating was completely resistant to rubbing by an isopropanol saturated Q-tip (curing time about 1–4 hours). The resulting hard cross-linked organosiloxane-silica hybrid polymer solid coating was completely resistant to rubbing by an isopropanol saturated Q-tip indicating that curing had taken place. The cured coating could not be removed from the cylinder by first applying to the overcoating and thereafter removing a strip of 3M 600 Scotch® adhesive tape. The overcoating was also clear and free of any cloudy areas.

EXAMPLE VII

A photoreceptor comprising a cylindrical aluminum substrate having a diameter of about 8.3 centimeters and a length of about 43 centimeters coated with a vacuum-deposited layer having a thickness of about 55–60 micrometers and containing about 65 percent by weight selenium, about 35 percent by weight arsenic was cleaned with isopropanol to remove any oxide or other contaminants. After drying, a Binks spray gun was employed to apply on the cylinder, at a relative humidity below 40% and at a room temperature of about 21° C., a 0.5% solution in methylene chloride/1,1,2 trichloroethane (6:4) mixture of a primer consisting of 0.4 gram poly(carbonate-co-ester) (Lexan 3250, available from General Electric Co.), 0.1 gram polymethyl methacrylate, 59.7 grams methylene and 39.8 grams 1,1,2 trichloroethane. The drum was then dried at 45° C. for 30 minutes to yield a film thickness of approximately 0.04 micrometer. This primed drum was overcoated with a film of a cross-linkable siloxanol-colloidal silica hybrid material. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid material solution, as determined by titration, was found to be below 1. This cross-linkable organosiloxane-silica hybrid material solution was diluted with ethanol to form a 10 percent solution and mixed with 3 percent aminosilane (Z-6020, available from Dow Corning) based on the weight of the cross-linkable organosiloxane-silica hybrid solids. The solution was applied to the primed cylinder with a spray gun. After air-drying at room temperature, the drum was thermally cured at about 100° C. in an air oven until the resulting hard cross-linked organosiloxane-silica hybrid polymer solid coating was completely resistant to rubbing by an isopropanol saturated Q-tip (curing time about 1–4 hours). The resulting hard cross-linked organosiloxane-silica hybrid polymer solid coating was completely resistant to rubbing by an isopropanol saturated Q-tip indicating that curing had taken place. The cured coating could not be removed from the cylinder by first applying to the overcoating and thereafter removing a strip of 3M 600 Scotch® adhesive tape. The overcoating was clear and free of cloudy areas.

EXAMPLE VIII

A photoreceptor comprising a cylindrical aluminum substrate having a diameter of about 8 centimeters and a length of about 26 centimeters coated with a transport layer having a thickness of about 15 micrometers and containing about N,N'-diphenyl-N-N'-bis(methylphenyl)-[1,1'-biphenyl]-4,4'diamine dispersed in polycarbonate resin and a photogenerator layer having a thickness of about 0.8 micrometer containing a phthalocyanine pigment dispersed in polyester (Vitel PE-100) was coated with a cross-linkable organosiloxane-silica hybrid material solution. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid material solution, as determined by titration, was found to be below 1. This cross-linkable organosiloxane-silica hybrid material solution was diluted with isobutanol/isopropanol (55:45) to form a 5 percent solution and mixed with 3 percent aminosilane (Z-6020, available from Dow Corning) based on the weight of the cross-linkable organosiloxane-silica hybrid solids. The solution was applied to the cylinder with a spray gun. After air-drying at room temperature, the drum was thermally cured at about 100° C. in an air oven until the resulting hard cross-linked organosiloxane-silica hybrid polymer solid coating was completely resistant to rubbing by an isopropanol saturated Q-tip (curing time, about 1 hour). The resulting hard cross-linked organosiloxane-silica hybrid polymer solid coating had a thickness of about 0.5 micrometer. The cured coating could not be removed from the cylinder by first applying to the overcoating and thereafter removing a strip of 3M 600 Scotch® adhesive tape. The overcoating was also clear and free of cloudy areas.

EXAMPLE IX

A photoreceptor comprising a cylindrical aluminum substrate having a diameter of about 8 centimeters and a length of about 26 centimeters coated with a transport layer having a thickness of about 15 micrometers and containing about 35 percent by weight of N,N'-diphenyl-N-N'-bis(methylphenyl)-[1,1'-biphenyl]-4,4'diamine dispersed in polycarbonate resin and a photo-generator layer having a thickness of about 0.8 micrometer containing a phthalocyanine pigment dispersed in polyester (Vitel PE-100) was coated with the a cross-linkable organosiloxane-silica hybrid material solution. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid material solution, as determined by titration, was found to be below 0.5. The cross-linkable organosiloxane-silica hybrid material solution was diluted with isobutanol/isopropanol (55:45) in 5% solution and mixed with 5 percent methyl trimethoxysilane (Z-6070, available from Dow Corning) based on the weight of the cross-linkable organosiloxane-silica hybrid solids. The solution was applied to the primed cylinder with an automatic spray gun. After air-drying at room temperature, the cylinder was thermally cured at about 100° C. in an air oven for about 4 hours. The resulting hard cross-linked organosiloxane-silica hybrid polymer solid coating was completely resistant to rubbing by an isopropanol saturated Q-tip. The resulting hard cross-linked organosiloxane-silica hybrid polymer solid coating had a thickness of about 0.5 micrometer. The cured coating could not be removed from the cylinder by first applying to the overcoating and thereafter removing a strip of 3M 600 Scotch® adhesive tape. The overcoating was also clear and free of cloudy areas.

EXAMPLE X

The procedures described in Example IX seemed were repeated with identical conditions and materials except that 10 percent methyl trimethoxysilane was used instead of 5 percent methyl trimethoxysilane. The results observed were substantially the same as that observed for the overcoated photoreceptor of Example IX.

EXAMPLE XI

A primer coating and protective overcoating were applied to a multilayer electrophotographic imaging member comprising an aluminized Mylar substrate having a thickness of about 3 mils, a generating layer having a thickness of about 1.5 micrometers containing 10 percent by weight trigonal selenium particles dispersed in polyvinylcarbazole, and a transport layer containing 40 percent by weight N,N'-diphenyl-N-N'-bis(methylphenyl)-[1,1'-biphenyl]-4,4'diamine dispersed in polycarbonate resin having a thickness of about 27 micrometers. After the photoreceptor was cleaned with isopropanol, a Binks spray gun was employed to apply on the transport layer, at a relative humidity below 40% and at a room temperature of about 21° C., a solution of 1.88 grams of low molecular weight polymethyl methacrylate, 525 grams of 2-methoxyethanol and 450 grams of isopropanol. After air-drying, the electrophotographic imaging member was dried at 100° C. for 1 hour to yield a film thickness of approximately 0.05 micrometer. This primed electrophotographic imaging member was overcoated with a film of cross-linkable siloxanol-colloidal silica hybrid material containing 8 percent solids in an ethanol solvent. This cross-linkable organosiloxane-silica hybrid material solution was essentially the same as the cross-linkable organosiloxane-silica hybrid material solution of Example I except that less acid was used in the preparation of the cross-linkable organosiloxane-silica hybrid material. The acid number of this cross-linkable organosiloxane-silica hybrid material solution, as determined by titration, was found to be below 1. This cross-linkable organosiloxane-silica hybrid material solution was diluted with ethanol and mixed with 5 percent methyl trimethoxysilane (Z-6070, available from Dow Corning) based on the weight of the cross-linkable organosiloxane-silica hybrid solids. The solution was applied to electrophotographic imaging member with a draw bar. After air-drying at room temperature, the plate was thermally cured at about 100° C. in an air oven for several hours to form a protective overcoating having a thickness of 0.8 micrometer. The resulting hard cross-linked organosiloxane-silica hybrid polymer solid coating was completely resistant to rubbing by an isopropanol saturated Q-tip indicating that curing had taken place. The cured coating could not be removed from the cylinder by first applying to the overcoating and thereafter removing a strip of 3M 600 Scotch® adhesive tape. The overcoating was also clear and free of cloudy areas.

EXAMPLE XII

The procedures described in Example XI were repeated with identical conditions and materials except that 10 percent methyl trimethoxysilane was used instead of 5 percent methyl trimethoxysilane. The results observed were substantially the same as that observed for the overcoated photoreceptor of Example XI.

EXAMPLE XIII

Electrical properties of the overcoated photoreceptors of Examples II through X as well as corresponding unovercoated photoreceptors were measured in an environmentally controlled scanner. The initial charge acceptance ($V_o$) of the overcoated photoreceptors, difference in initial charge acceptance of each half of the overcoated photoreceptor compared to the corresponding half of the unovercoated photoreceptor ($\Delta V_o$), sensitivity at to light having a wavelength 825 nanometers ($S_{825}$), difference in dark decay discharge voltage between each half of the overcoated photoreceptor and the corresponding half of the unovercoated photoreceptor ($\Delta V_{DDP}$), residual potential ($V_R$), and difference in residual potential between each half of the overcoated photoreceptor and the corresponding half of the unovercoated photoreceptor ($\Delta V_R$) were measured. The most important variable is the residual potential, which affects background toner deposits. With continuous cycling, $V_R$ increases (cycles-up) or decreases (cycles-down) depending on the type of charge applied to the photoreceptor surface. The following results were obtained after one cycle in a scanner:

| Ex. No. | $V_o$ (V) | $\Delta V_o$ (V) | $S_{825}$ (V/erg/cm$^2$) | $\Delta V_D$ (V/sec) | $V_R$ (V) | $\Delta V_R$ (V) |
|---|---|---|---|---|---|---|
| II | 1140 | 30 | — | — | 19 | — |
| III | 1140 | 40 | — | — | — | 50 |
| IV | 1100 | 75 | — | — | — | 40 |
| V | 1090 | 80 | — | — | 73 | 44 |
| VIII | 860 | 240 | — | — | 95 | 80 |
| IX | 875 | 180 | 54 | 57 | 80 | — |
| X | 892 | 110 | 60 | 64 | 49 | 31 |
| XI | −850 | −20 | — | — | — | 50 |
| XII | −850 | 0 | — | — | — | 22 |

For the photoreceptors in II–V, and VIII–X, the charge applied was positive, while for the photoreceptors in XI and XII, the charge applied was negative. A relatively low $V_R$ of less than about 100 volts positive or negative is preferred so that $\Delta V_R$ is unlikely to exceed about 200 volts upon cycling. As the number of cycles is increased, the value of $\Delta V_R$ can increase substantially. When the value of $\Delta V_R$ exceeds about 200 volts, background can increase dramatically.

EXAMPLE XIV

A control experiment was conducted with a photoreceptor comprising a cylinderical aluminum substrate having a diameter of about 8.3 centimeters and a length of about 33 centimeters coated with a vacuum-deposited first layer having a thickness of about 55 micrometers and containing about 99.5 percent by weight selenium, about 0.5 percent by weight arsenic and about 20 parts-per-million chlorine and a vacuum deposited second outer layer having a thickness of about 5 micrometers and containing about 90 percent by weight selenium and about 10 percent by weight tellurium. A primer containing a 0.5% solution of an 80:20 weight ratio of polyester (Vitel PE-200, available from Goodyear Rubber & Tire Co.)/polymethyl methacrylate in a 1:1 volume ratio of $CH_2Cl_2/Cl_2CHCH_2Cl$ was applied by dip-coating in a cylindrical glass vessel. The flow time was about 5–6 seconds. The drum was air-dried and then thermally dried at 45° C. for 30 minutes to form a continuous coating having a thickness of less than about 0.04 micrometer. This primed drum was overcoated with a film of cross-linkable siloxanol-colloidal silica hybrid material commercially available from Dow Corning as Vestar containing 23.5 percent solids in a methanol/isopropanol/alkanol ether mixture. This cross-linkable organosiloxane-silica hybrid material solution contained 2 percent by weight of potassium acetate which functions as a high temperature cross-linking (curing) catalyst for the organosiloxane-silica hybrid material. The acid number of this cross-linkable organosiloxane-silica hybrid material solution containing potassium acetate, as determined by titration, was found to be 60. The titration procedures are as described previously. The solution was diluted with ethanol-butanol (99:1) to form a 10% solution and 3% potassium acetate was added based on the silicone-silica hybrid. The solution was applied by spraying. After air-drying at room temperature, the drum was thermally cured for 60 minutes at about 45°–50° C. in an air oven. The cured cross-linked organosiloxane-silica solid polymer coating had a thickness of about 0.5 micrometer and could not be scratched with a sharpened 5H pencil. This overcoated photoreceptor was cycled through conventional xerographic imaging steps comprising uniform charging, exposure to a test pattern to form an electrostatic latent image corresponding to the test pattern, development with a magnetic brush developer applicator to form a toner image corresponding to the electrostatic latent image, electrostatically transfering the toner image to a sheet of paper and cleaning the overcoated photreceptor. The cycling was conducted in an controlled environment in which the temperature was maintained at 27° C. and the relative humidity maintained at 80 percent. Examination of the transferred toner images after 1,000 cycles revealed numerous print deletions.

EXAMPLE XV

A photoreceptor comprising a cylindrical aluminum substrate having a diameter of about 8.3 centimeters and a length of about 43 centimeters coated with a vacuum deposited first layer having a thickness of about 55 micrometers and containing about 99.5 percent by weight selenium, about 0.5 percent by weight arsenic and about 20 parts-per-million chlorine and a vacuum-deposited second outer layer having a thickness of about 5 micrometers and containing about 90 percent by weight selenium and about 10 percent by weight tellurium. A primer containing a 0.5% solution of an 80:20 weight ratio of polyester (Vitel PE-200 available from Goodyear Rubber & Tire Co.)/polymethyl methacrylate in a 1:1 volume ratio of $CH_2Cl_2/Cl_2CHCH_2Cl$ was applied by dip-coating in a cylindrical glass vessel. The flow time was about 5–6 seconds. The drum was then air-dried and dried at 45° C. for 30 minutes to form a contiuous coating having a thickness of less than about 0.04 micrometer. This primed drum was overcoated with a film of cross-linkable siloxanol-colloidal silica hybrid material. This cross-linkable organosiloxane-silica hybrid material solution was essentially the same as the cross-linkable organosiloxane-silica hybrid material solution of Example I except that no acid was used in the preparation of the cross-linkable organosiloxane-silica hybrid material. The acid number of this cross-linkable organosiloxane-silica hybrid material as determined by titration, was found to be less than 1. This cross-linkable organosiloxane-silica hybrid material solution for spraying contained 58.6 grams of a 23.5 weight percent solution of the cross-linkable organosiloxane-silica hybrid material dissolved in an isobutanol/isopropanol mixture, 116 grams of isopropanol, 224 grams of isobutanol, 1.4 grams of a low molecular weight hydroxy-terminated polydimethylsiloxane (Petrarch fluid available from Petrarch Chemical, Florida), and 0.5 gram of gamma-aminopropyltriethoxysilane (A-1100 Silane, available from Union Carbide Co.). The solution was applied by spraying. After air-drying at room temperature, the drum was thermally cured for 3 hours at about 34°–50° C. in a forced-air oven. The cured cross-linked organosiloxane-silica solid polymer coating had a thickness of about 0.5 micrometer and could not be scratched with a sharpened 5H pencil. This overcoated photoreceptor was cycled through xerographic imaging steps comprising uniform charging to 5.8 kV, exposure to a test pattern to form an electrostatic latent image corresponding to the test pattern, development with a magnetic brush developer applicator to form a toner image corresponding to the electrostatic latent image, electrostatically transfering the toner image to a sheet of paper and cleaning the overcoated photreceptor. The cycling was conducted in an controlled environment in which the temperature was maintained at 27° C. and the relative humidity maintained at 80 percent. Examination of the transferred toner images after 1,000 cycles revealed no print deletions. In comparing the results of this Example with that of Example XIV, it is apparent that the print deletion characteristics of a photoreceptor overcoated with a cured cross-linked organosiloxane-silica solid polymer are significantly affected by the presence or substantial absence of ionic components.

EXAMPLE XVI

The procedures described in Example XV were repeated with identical conditions and materials except that 0.7 gram octyl triethoxysilane was used instead of 1.4 grams of a low molecular weight hydroxy-terminated polysiloxane. The results observed were substantially the same as that observed for the overcoated photoreceptor of Example XV.

The invention has been described in detail with particular reference to preferred embodiments thereof and it will be understood that variations and modifications can be effected within the spirit and scope of the invention as described hereinabove, and as defined in the appended claims.

We claim:

1. A process for forming an overcoated electrophotographic imaging member comprising the steps of providing an electrophotographic imaging member, applying a final outer coating in liquid form comprising a cross-linkable siloxanol-colloidal silica hybrid material having at least one silicon bonded hydroxyl group per every three —SiO— units on said electrophotographic imaging member and a catalyst for said cross-linkable siloxanol-colloidal silica hybrid material, said coating in liquid form having an acid number less than about 1, and curing said cross-linkable siloxanol-colloidal silica hybrid material until said siloxanol-colloidal silica hybrid material forms a hard cross-linked solid organosiloxane-silica hybrid polymer layer substantially free of any detectable acid and having a thickness between about 0.3 and about 3 micrometers.

2. A process according to claim 1 including heating said coating to activate said catalyst until said coating forms said hard cross-linked solid organosiloxane-silica hybrid polymer layer.

3. A process according to claim 2 wherein said coating in liquid form includes a plasticizer for said siloxanol-colloidal silica hybrid material.

4. A process according to claim 3 wherein said plasticizer is a dimethyl polysiloxane having hydroxyl end groups.

5. A process according to claim 3 wherein said plasticizer is a octyl trimethoxysilane.

6. A process according to claim 1 wherein said curing of said coating is continued until said hard cross-linked organosiloxane-silica hybrid polymer layer is substantially insoluble in isopropyl alcohol.

7. A process according to claim 1 wherein said coating is applied to an amorphous selenium layer of an electrophotographic imaging member.

8. A process according to claim 1 wherein said coating is applied to a selenium alloy layer of an electrophotographic imaging member.

9. A process according to claim 1 wherein said coating is applied to a charge generating layer of an electrophotographic imaging member.

10. A process according to claim 1 wherein said coating is applied to a primer layer on said electrophotographic imaging member.

11. A process according to claim 1 wherein said coating is applied to a charge transport layer of an electrophotographic imaging member.

12. A process according to claim 11 wherein said charge transport layer comprises a diamine dispersed in a polycarbonate resin, said diamine having the formula:

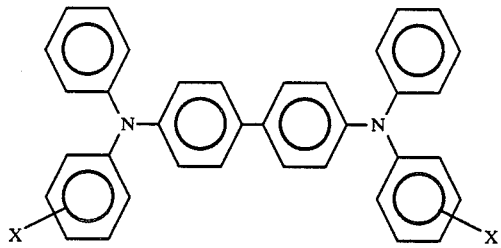

wherein X is selected from the group consisting of $CH_3$ and Cl.

* * * * *